US005216958A

United States Patent [19]

Kurtz

[11] Patent Number: 5,216,958

[45] Date of Patent: Jun. 8, 1993

[54] BRAKE ARRANGEMENT FOR A RAILROAD GONDOLA CAR WITH TIE ROD RUNNING INSIDE CENTER SILL

[75] Inventor: William E. Kurtz, Johnstown, Pa.

[73] Assignee: Johnstown America Corporation, Chicago, Ill.

[21] Appl. No.: 817,341

[22] Filed: Jan. 6, 1992

[51] Int. Cl.[5] ..... B61D 7/00

[52] U.S. Cl. ..... 105/247; 105/416; 105/463.1; 188/52

[58] Field of Search ..... 105/247, 248, 413, 416, 105/418, 463.1; 188/49, 52, 197

[56] References Cited

U.S. PATENT DOCUMENTS

| | | | |
|---|---|---|---|
| 3,372,779 | 3/1968 | Roselius et al. | 188/52 X |
| 3,378,112 | 4/1968 | Roselius et al. | 188/52 X |
| 3,533,492 | 10/1970 | Campbell | 188/52 X |
| 3,543,889 | 12/1970 | Roselius et al. | 188/197 |
| 3,626,484 | 12/1971 | Kinnecom | 188/52 |
| 3,889,783 | 6/1975 | Sittner, Jr. et al. | 188/52 |
| 4,079,818 | 3/1978 | Chierici | 105/463.1 |
| 4,128,148 | 12/1978 | Schmitt | 188/52 X |
| 4,166,520 | 9/1979 | Baker et al. | 105/418 X |
| 4,280,596 | 7/1981 | Miller | 105/247 X |
| 4,346,790 | 8/1982 | Morrison et al. | 188/52 X |
| 4,493,266 | 1/1985 | Augustine, Jr. | 105/418 X |

*Primary Examiner*—Robert J. Oberleitner
*Assistant Examiner*—S. Joseph Morano

[57] ABSTRACT

A brake arrangement for a railroad car having a semi-closed box beam center sill and including a first aperture communicating with the interior of the center sill, a second aperture communicating with the interior of the center sill, a tie rod extending between the first and second apertures, the tie rod extending along the interior of the center sill and having a first end pivotally attached to a first lever extending through the first aperture and attached to brake linkage, and a second end pivotally attached to a second lever extending through the second aperture and attached to brake linkage.

10 Claims, 2 Drawing Sheets

BRAKE ARRANGEMENT FOR A RAILROAD GONDOLA CAR WITH TIE ROD RUNNING INSIDE CENTER SILL

BACKGROUND OF THE INVENTION

This invention relates to railroad car brakes and more particularly to the arrangement of brake regulator components along the interior length of a center sill in a twin pod gondola or hopper type car.

It has long been recognized that brake systems for these types of cars, which includes the brake regulator components, is subjected to various adverse environmental conditions. The location of the brake regulator components along the underside of a car exposes the brake parts to an assortment of track debris which can clog and/or damage the brake system as the car travels along railroad trackwork. In addition, during winter conditions, bulk freight such as sand, gravel, coal, ore and the like, can become frozen within the car. In such cases, freight thawing apparatus, such as high intensity burners, are placed under the cars to thaw the frozen bulk freight. These high heat sources not only thaw the freight within the car, but also damage the brake components which are exposed along the underside length of the car.

Heretofore there have been numerous attempts to solve the brake system problems set fourth above. One such attempt is shown in a set of three continuing United States patents granted to Roselius, et al. In his first patent, U.S. Pat. No. 3,372,779, Roselius recognizes that when brake components are placed on the underside of a railroad car they are subjected to possible heat damage during thawing operations. In an attempt to eliminate such heat damage to the brake parts, Roselius positions his brake regulator (72) near one end of the car at a location above the center sill (14). In his subsequent patents, U.S. Pat. Nos. 3,378,112 and 3,543,889, Roselius further discloses a brake arrangement which positions both the brake regulator, as well its related connecting or tie rods, above the center sill of the car. This brake regulator arrangement extends along the length of the car and includes protective hood sheets (19) and (29) within the hopper portions of the car.

U.S. Pat. No. 3,533,492, to Campbell, shows a different brake system design for overcoming the above-stated damage problems which can occur to the brake system on a railroad car. Campbell simply installs a separate, and complete brake system at each end of his railroad car, and thereby eliminates the need to place his brake components in areas which are heated with freight thawing apparatus.

In U.S. Pat. No. 4,280,596, directed to a brake arrangement for a center sill-less hopper car, Miller discloses a brake arrangement similar to the brake system shown in the Roselius patents. Miller's brake components extend along the length of the railroad car and through the hopper portions of the gondola car at an elevation which is comparable to the location shown by Roselius. However, Miller does not show a using a protective hood sheet with his brake components as disclosed in the Roselius patents.

Each of the above patents shows improvements which reduces damage to the a brake system from either track debris or thawing apparatus. However, each of the above patented brake systems have inherent disadvantages which can be improved upon. First, Campbell's brake system employs a separate, and complete brake system at each end his gondola car. This brake system is expensive to both install and maintain. Second, Miller's brake system effectively removes the brake components from areas of the gondola car where heat and track debris can cause damage to the brake system. However, Miller introduces a new source for brake system damage in the areas where his unprotected brake components extend through the hopper portions of the car. Such unprotected portions of tie rods, extending through the hopper portion of the car, are damaged by the weight of the bulk freight being transported within the car. And finally, Roselius discloses protecting his tie rods by installing hood sheets over the tie rod portions extending through the hopper section of his car. Under normal conditions, such hood sheets prevent the bulk freight from damaging the tie rods. However, at times, freight handlers find it necessary to unload gondola cars using clam shell buckets. When such unloading operations take place, the clam shell buckets damage the protective hood sheets causing certain failure of the railroad car brake system.

SUMMARY OF THE INVENTION

It is therefore an object of this invention to provide a railroad car brake system arrangement which is protected from damage by freight thawing apparatus.

It is a further object of this invention to provide a railroad car brake system arrangement which is protected from damage from trackwork debris.

It is still a further object of this invention to provide a brake system arrangement which is inexpensive, simple to install, and easily maintained.

It is still a further object of this invention to provide a brake system arrangement which will overcome the above-stated disadvantages of the prior patents by providing a brake arrangement which is not exposed to damage from either the bulk freight within the car, or by unloading equipment.

We have discovered that the foregoing objects can be attained with a brake system arrangement comprising a semi-closed box beam center sill having a first aperture communicating with the interior of the center sill, a second aperture communicating with the interior of the center sill, a tie rod extending between the first and second apertures, the tie rod extending along the interior of the center sill and having a first end pivotally attached to a first lever which extends through the first aperture and is attached to brake linkage, and a second end pivotally attached to a second lever which extends through the second aperture and is attached to brake linkage.

DETAILED DESCRIPTION OF THE INVENTION

Figure 1A:
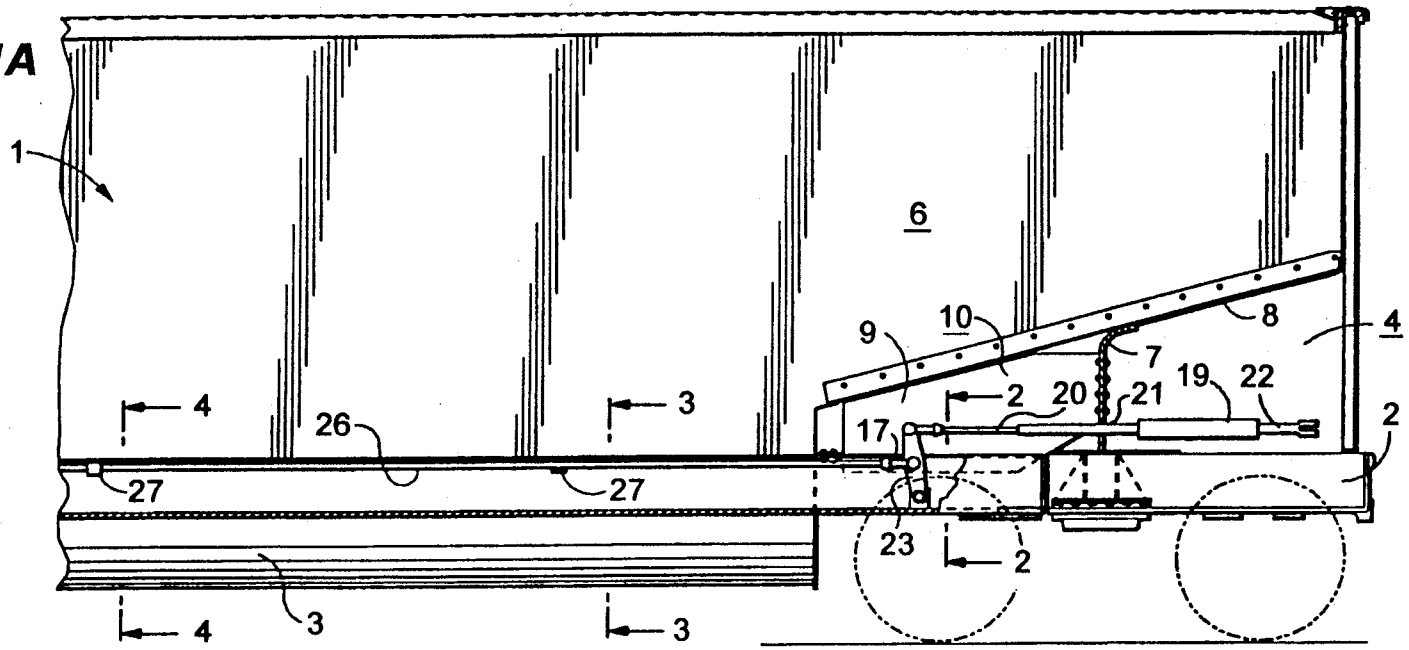
FIG. 1A is a cross-sectional, elevational view showing one end of a twin pod railroad gondola car or hopper type car and the brake arrangement of the invention.
Figure 3:
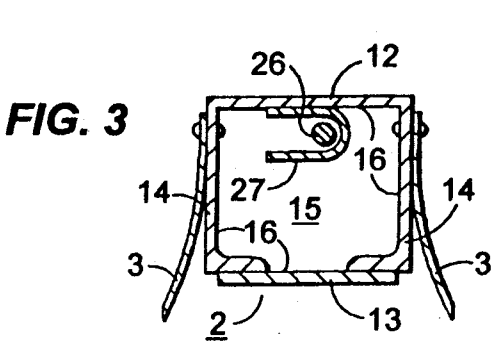
FIG. 3 is a cross-sectional view similar to FIG. 2 taken along the lines 3—3 of FIG. 1.
Figure 4:
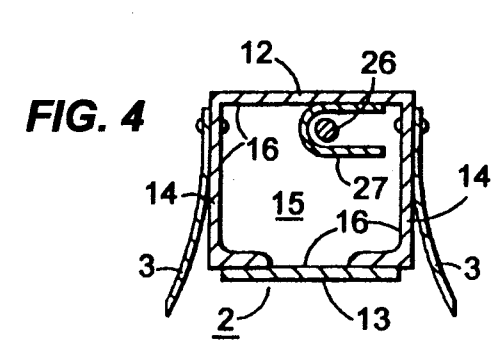
FIG. 4 is a cross-sectional view also similar to FIG. 2 taken along the lines 4—4 of FIG. 1.
Figure 2:
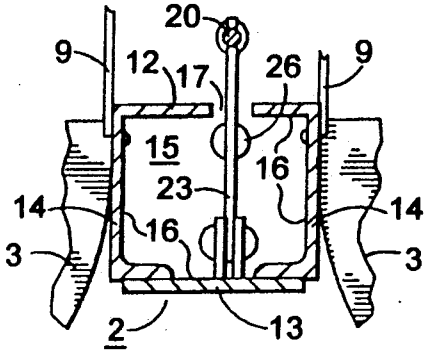
FIG. 2 is a cross-sectional view taken along the lines 2—2 of FIG. 1, showing the interior of the center and brake arrangement invention.
Figure 5:
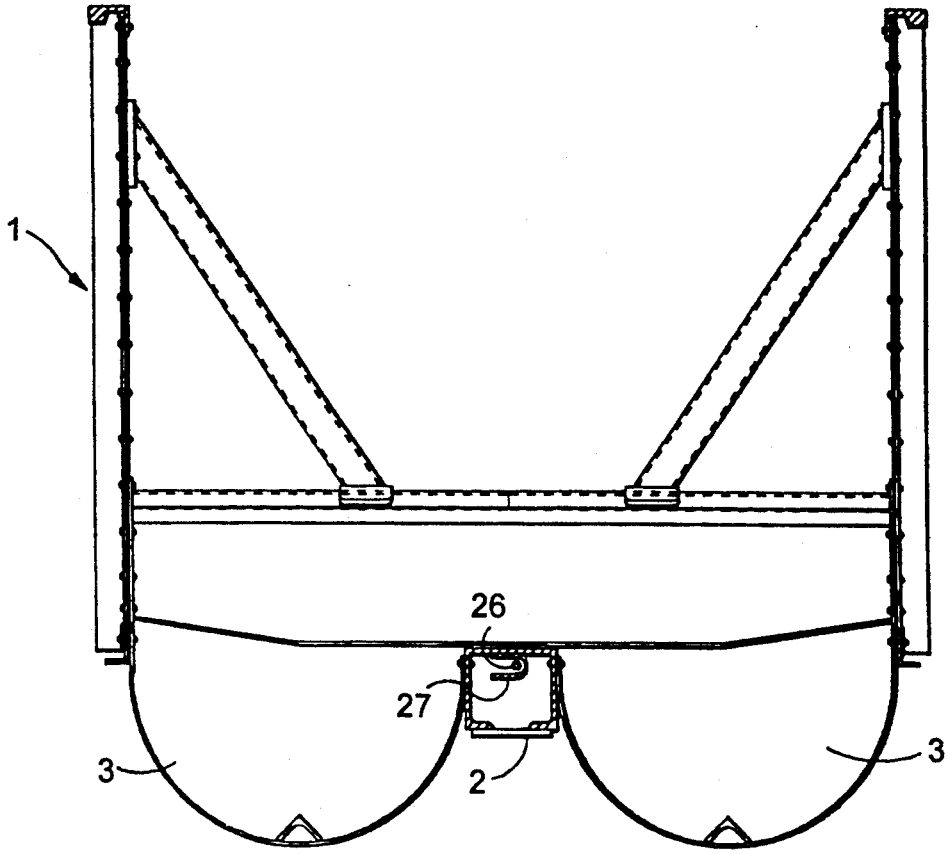
FIG. 5 is a transverse, cross-sectional view of the twin pod railroad gondola car of the invention showing center sill and brake arrangement between the twin pods of the car.
Figure 1B:
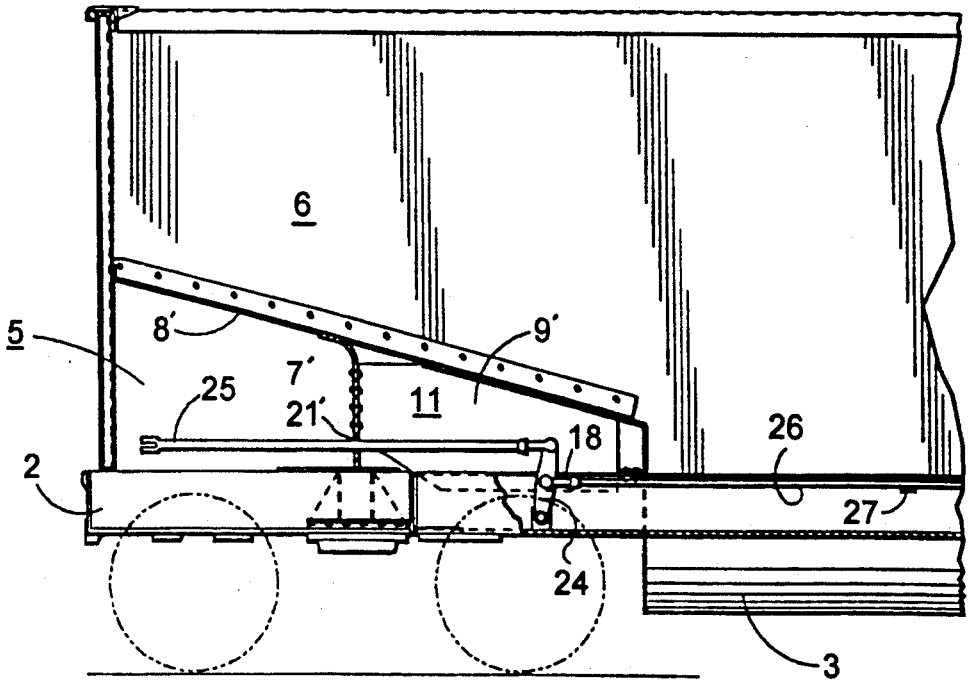
FIG. 1B is a view similar to FIG. 1A showing the opposite end of the twin pod railroad gondola car.

Referring to FIGS. 1A, 1B and 5 of the drawings, the preferred embodiment of the invention is shown comprising a railroad gondola or hopper car 1 having a semi-closed box beam center sill 2, twin pods or hoppers 3, a first end portion 4, a second end portion 5. and a hopper portion 6.

The first end portion 4 of the gondola car includes a sloped floor 8, a transverse bulkhead 7 attached to and extending between sloped floor piece 8 and center sill 2, and side walls 9 attached to sloped floor piece 8, center sill 2, and the transverse bulkhead 7. The center sill 2, along with bulkhead 7, sloped floor 8, and side walls 9, form a first enclosure 10 located between the first end portion 4 and the twin pods 3. Likewise, the second end portion 5 of the gondola car includes an opposite hand, second enclosure 11. Enclosure 11 is comprised of the center sill 2, a transverse bulkhead 7 , side walls 9 and a second sloped floor piece 8.

Center sill 2, extending between end portions 4 and 5, is located between twin pods or hoppers 3 and includes a top portion 12, a bottom portion 13, and side walls 14. The center sill is a box like, elongated structural beam member having an interior portion 15 with interior surfaces 16. A first aperture 17, located within first enclosure 10, extends through top portion 12 of the center sill and communicates with interior portion 15 of the center sill. A second aperture 18, located within second enclosure 11, also extends through top portion 12 of the center sill and communicates with interior portion 15.

Pneumatic brake equipment (not shown), of the conventional type used for such cars, is located at the first end portion 4 of the car along with a brake regulator 19, or slack adjuster. The brake regulator comprises a cylinder 19, a first piston rod 20, and a second piston rod 22. The first piston rod 20 extends from cylinder 19, through an aperture 21 within bulkhead 7, and into the interior portion of first enclosure 10 to a position above first aperture 17. Second piston rod 22 includes means at one end for attaching the brake regulator to the hydraulic brake equipment and truck brake linkage located at the first end portion of the car.

A first lever 23, having one end pivotally attached to an interior surface 16 of the center sill, extends through first aperture 17 and is pivotally attached at its opposite end to first piston rod 20. Like wise, a second lever 24, having one end pivotally attached to an interior surface 16 of center sill 2, extends through second aperture 18 and is pivotally attached at its opposite end to a connecting rod 25 positioned above aperture 18 within enclosure 11. Connecting rod 25 extends through aperture 21' within bulkhead 7', and the opposite end of connecting rod 25 includes means for attachment to brake linkage (not shown) for the truck located at the second end portion 5 of said car.

Elongated tie rod 26, shown extending along the interior portion 15 of the center sill, provides means for extending brake slack adjustment to the truck brakes located at end portion 5 opposite the slack regulator 19. Tie rod 26 includes a first end pivotally attached to first lever 23, and a second end pivotally attached to second lever 24. A plurality of spaced apart tie rod supports 27 are attached to an interior surface 16 of the center sill, and the supports are arranged along the interior portion 15 to provide support for tie rod 26. The supports are shown as "U" shaped brackets sequentially rotated 180° to capture tie rod 26 within the "U" shape of the brackets.

While this invention has been illustrated and described in accordance with a preferred embodiment, it is recognized that this brake arrangement invention can be used with any center sill type railroad car and variations and changes may be made therein without departing from the invention as set forth in the claims.

I claim:

1. A brake arrangement for a railroad car comprising:
   a) a center sill extending between a first end and a second end of said railroad car the center sill including an exterior portion and an interior portion, said center sill provided with a first aperture communicating with said interior portion and a second aperture communicating with said interior portion,
   b) a brake regulator located between said first aperture and said first end, said brake regulator positioned above said center sill,
   c) a first lever having one end pivotally attached to an interior surface of said interior portion, said first lever extending through said first aperture and having its opposite end pivotally attached to said brake regulator,
   d) a second lever having one end pivotally attached to an interior surface of said interior portion, said second lever extending through said second aperture and having its opposite end pivotally attached to a connecting rod located between said second aperture and said second end, said connecting rod positioned above said center sill, and
   e) a tie rod having a first end pivotally attached to said first lever and a second end pivotally attached to said second lever, said tie rod extending along the interior portion of said center sill.

2. The aperture as described in claim 1 wherein said center sill is a box beam including a top member, a bottom member, and side walls.

3. The apparatus as described in claim 2 wherein said first aperture extends through said top member.

4. The aperture as described in claim 2 wherein said second aperture extends through said top member.

5. The apparatus described in claim 3 wherein said first lever is pivotally attached to said interior surface opposite said first aperture.

6. The apparatus described in claim 4 wherein said second lever is pivotally attached to said interior surface opposite said second aperture.

7. The apparatus described in claim 1 wherein tie rod support means are spaced apart along the interior portion of said center sill.

8. The apparatus described in claim 7 wherein said tie rod support means are "U" shaped brackets arranged along the length of said tie rod and sequentially rotated 180°.

9. A brake arrangement for a railroad car having a semi-closed box beam center sill extending between a first end and a second end of the railroad car, comprising: a first aperture communicating with the interior of said center sill at said first end, a second aperture communicating with the interior of said center sill at said second end, a tie rod extending between said first aperture and said second aperture, said tie rod extending along the interior of said center sill and having a first end pivotally attached to a first lever extending through said first aperture at said first end of said railroad car, and a second end pivotally attached to a second lever extending through said second aperture at said second end of said railroad car, said first and second levers being pivotally affixed to said center sill within said interior.

10. The apparatus in claim 9 wherein said first lever is attached to a brake regulator.

* * * * *